US005942360A

United States Patent [19]

Janezic et al.

[11] Patent Number: 5,942,360

[45] Date of Patent: Aug. 24, 1999

[54] PHOTORECEPTOR WITH LOW SURFACE ENERGY AND PROCESS OF MAKING

[75] Inventors: Roger T. Janezic, Rochester; William W. Limburg, Penfield; Mark Petropoulos, Ontario; Rachael A. Forgit, Rochester; Mark S. Thomas, Williamson; Russell N. Gillmeister, Fairport, all of N.Y.

[73] Assignee: Xerox Corporation, Stamford, Conn.

[21] Appl. No.: 09/050,360

[22] Filed: Mar. 31, 1998

[51] Int. Cl.[6] ..... G03G 5/147

[52] U.S. Cl. ..... 430/58; 430/59; 430/66; 430/67; 430/132; 428/321.1

[58] Field of Search ..... 430/58, 59, 66, 430/67, 132; 428/321.1

[56] References Cited

U.S. PATENT DOCUMENTS

| | | | |
|---|---|---|---|
| 3,885,965 | 5/1975 | Hughes et al. | 430/448 |
| 4,078,927 | 3/1978 | Amidon et al. | 430/49 |
| 4,218,514 | 8/1980 | Pacansky et al. | 428/447 |
| 4,254,208 | 3/1981 | Tatsuta et al. | 430/215 |
| 4,265,990 | 5/1981 | Stolka et al. | 430/59 |
| 4,332,715 | 6/1982 | Ona et al. | 524/265 |
| 4,340,658 | 7/1982 | Inoue et al. | 430/58 |
| 4,388,392 | 6/1983 | Kato et al. | 430/58 |
| 4,519,698 | 5/1985 | Kohyama et al. | 399/346 |
| 4,571,371 | 2/1986 | Yashiki | 430/62 |
| 4,738,950 | 4/1988 | Vanier et al. | 503/229 |
| 4,784,928 | 11/1988 | Kan et al. | 430/58 |
| 4,962,008 | 10/1990 | Kimura et al. | 430/67 |
| 4,966,797 | 10/1990 | Ishihara et al. | 428/321.1 |
| 5,069,993 | 12/1991 | Robinette et al. | 430/58 |
| 5,164,276 | 11/1992 | Robinson et al. | 430/59 |
| 5,213,928 | 5/1993 | Yu | 430/66 |
| 5,324,609 | 6/1994 | Yagi et al. | 430/66 |
| 5,382,489 | 1/1995 | Ojima et al. | 430/96 |

FOREIGN PATENT DOCUMENTS

| | | | |
|---|---|---|---|
| 2-11389 | 1/1990 | Japan | 428/321.1 |
| 2-122986 | 5/1990 | Japan | 428/321.1 |
| 2-132127 | 5/1990 | Japan | 428/321.1 |

*Primary Examiner*—Roland Martin
*Attorney, Agent, or Firm*—Oliff & Berridge, PLC

[57] ABSTRACT

A photoreceptor includes a supporting substrate and an outer layer on the photoreceptor, the outer layer including silicone oil uniformly dispersed as vesicles in a continuous film forming polymer matrix. This photoreceptor is used in a xerographic copier/printer machine and contributes to a longer operating life of the machine by providing continuous lubrication, decreased friction and decreased wear of the interaction of the photoreceptor and other machine parts. This photoreceptor is prepared by incorporating silicone oil and at least one film forming polymer in at least one solvent, removing the solvent and forming a dried outer layer in which the silicone oil is phase separated from the other components of the top layer forming small vesicles which are uniformly dispersed in the continuous film forming polymer matrix. The silicone oil provides lubricity to the outer surface of the photoreceptor without adversely affecting print quality and this lubricity is renewed throughout the life of the photoreceptor.

17 Claims, 1 Drawing Sheet

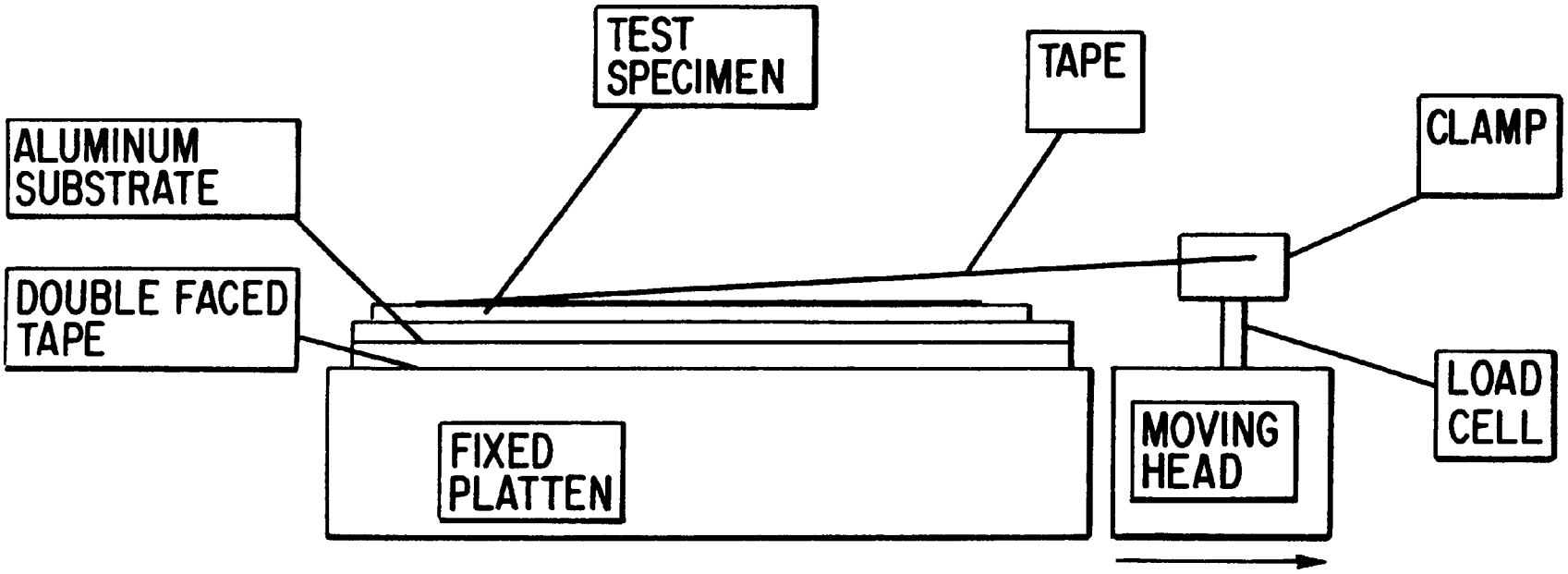
CLAMP
LOAD CELL
MOVING HEAD
TAPE
TEST SPECIMEN
FIXED PLATTEN
ALUMINUM SUBSTRATE
DOUBLE FACED TAPE

PHOTORECEPTOR WITH LOW SURFACE ENERGY AND PROCESS OF MAKING

BACKGROUND OF THE INVENTION

This invention relates generally to organic photoconducting devices and, in particular, to a photoreceptor having an outer layer comprising minute pockets of silicone oil, particularly in the form of vesicles dispersed in a film forming polymer matrix.

In electrophotography, a photoreceptor containing a photoconductive insulating layer on a conductive layer is imaged by first uniformly electrostatically charging its surface. The photoreceptor is then exposed to a pattern of activating electromagnetic radiation, such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided toner particles on the surface of the photoconductive insulating layer. The resulting visible image may then be transferred from the photoconductor to a support, such as transparency or paper. This imaging process may be repeated many times.

Photoreceptors may be provided in a number of forms. For example, the photoreceptor may be a homogeneous layer of a single material such as vitreous selenium or it may be a composite layer containing a photoconductor and at least one other material. One type of composite imaging member comprises a layer of finely divided particles of a photoconductive inorganic compound dispersed in an electrically insulating organic resin binder. In U.S. Pat. No. 4,265,990, a layered photoreceptor is disclosed having separate photogenerating and charge transport layers. The photogenerating layer is capable of photogenerating holes and injecting the photogenerated holes into the charge transport layer.

Other composite photoreceptors have been developed having numerous layers, which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional optional layers such as an anti-curl back coating and an overcoating layer.

Photoreceptors are generally exposed to repetitive electrostatographic cycling, which subjects exposed layers thereof to abrasion and leads to a gradual deterioration of the mechanical and electrical characteristics of the exposed layers. For example, repetitive cycling has adverse effects on the exposed surface of the outer imaging layer of the imaging member which is generally the charge transport layer, charge generating layer, overcoating layer, electrographic imaging layer and the like. When blade cleaning is utilized to remove residual toner particles from the imaging surface of photoreceptors, particles often adhere to the imaging surface and form comet shaped deposits during cycling. These deposits cannot be readily removed by blade cleaning and appear as undesirable defects in the final print output.

It has also been discovered that glue particles from wrappers utilized for packaging copy paper often accumulate on the photoreceptor surface and cannot be readily removed by cleaning blades. These deposits form black spots on the final print output. In addition, paper fibers cling to the imaging surface and cause print-out defects that also appear as black spots.

Also, the high contact friction that occurs between the cleaning blade and the imaging surface of the photoreceptor tends to wear both the blade and the imaging surface. Reduction in charge transport layer thickness due to wear increases the electrical field across the layer thereby increasing the dark decay and shortening the electrophotographic service life of the imaging member.

Attempts have been made to compensate for wear of the imaging surface. One method has been to increase the thickness of charge transport layers; however, this causes a decrease in the electrical field, which then alters the photoelectric performance and degrades the copy printout quality, which, in turn, requires more sophisticated equipment to compensate for the thicker charge transporting layer. Moreover, in the above method, the change in transport layer thickness as it wears away alters the electrical properties of the photoreceptor and consequently alters the quality of images formed. Attempts have been made to overcome these problems. However, the solution of one problem often leads to additional problems. The following references disclose various problems associated with attempts to improve the wear of photoreceptors.

U.S. Pat. No. 4,078,927 to Amidon et al., issued Mar. 14, 1978, discloses a planographic printing master comprising an ink releasing photoconductive insulating layer and an ink receptive particulate image pattern. The master may be formed from (1) a block copolymer containing polymeric segments from a siloxane monomer and polymeric segments from a non-siloxane monomer and (2) activator compounds, where appropriate (e.g., see line 65, column 3 through line 41, column 4).

U.S. Pat. No. 4,469,764 to Nakazawa et al., issued Sep. 4, 1984, discloses a photosensitive material for electrophotography comprising a dispersion of a charge generating pigment in a charge transporting medium composed mainly of a polyvinyl carbazole resin, wherein a specific perylene pigment is dispersed and incorporated as a charge generating pigment and a specific benzoquinone. A leveling agent such as polydimethylsiloxane may be added to improve surface smoothness of the photosensitive layer (e.g., see column 4, lines 66 through 68).

U.S. Pat. No. 4,332,715 to Ona et al., issued Jun. 1, 1982, discloses a vinyl resin composition obtained by mixing with the vinyl resin a minor portion of an organopolysiloxane that bears one or more acyloxyhydrocarbyl radicals bonded to silicon in the organopolysiloxane.

U.S. Pat. No. 4,784,928 to Kan et al., issued Nov. 15, 1988, discloses an electrophotographic imaging element in which image transfer properties are improved by heterogeneously dispersing, as a separate phase within the photoconductive surface layer of the element, finely divided particles of an abhesive substance. The abhesive substance is non-conductive and spreadable onto which toner particles adhere less strongly than to the composition of the surface layer in the adhesive substance. Various specific materials are disclosed in column 3, lines 1 through 34, including poly(dimethylsiloxane) liquids.

U.S. Pat. No. 4,340,658 to Inoue et al., issued Jul. 20, 1982, and U.S. Pat. No. 4,388,392 to Kato et al., issued Jun. 14, 1983, disclose a photosensitive layer in which surface smoothness may be improved by the addition of a leveling agent such as polydimethylsiloxane to a polyvinyl carbazole type photoconductor.

U.S. Pat. No. 4,738,950 to Banier et al., issued Apr. 19, 1988, discloses a dye-donor element for thermal dye transfer comprising a support having on one side thereof a dye layer and on the other side a slipping layer comprising a lubricating material disposed in a polymeric binder, the lubricating material comprising a linear or branched aminoalkyl-terminated poly-dialkyl, diaryl or alkylaryl siloxane.

U.S. Pat. No. 4,254,208 to Tatsuta et al., issued Mar. 3, 1981, discloses a process for producing a photographic material comprising dispersing in a solution of organic resin, a material that is incompatible with the organic resin to form a dispersion, coating the resulting dispersion on at least one side of a support to form a coated layer, and then drying the coated layer, the material dispersed being a solid at ordinary temperature and in a liquid phase during the dispersing, whereby the coated layer when dried contains solid particular dispersed therein due to solidification of the dispersed material.

U.S. Pat. No. 4,218,514 to Pacansky et al., issued Aug. 19, 1980, discloses an improved waterless lithographic printing master comprising a crosslinked blocked copolymer containing elastic ink releases siloxane blocks chemically linked to organic imaging accepting thermoplastic blocks.

U.S. Pat. No. 3,885,965 to Hughs et al., issued May 27, 1975, discloses a photothermographic element comprising a support having thereon a photothermographic layer comprising a photosensitive silver salt, a polymeric, hydrophobic binder and a poly(dimethylsiloxane).

U.S. Pat. No. 4,519,698 to Kohyama et al. discloses a method in which a waxy lubricant is employed to constantly lubricate a cleaning blade.

U.S. Pat. No. 5,069,993 to Robinette discloses photoreceptor layers containing polydimethylsiloxane copolymers.

U.S. Pat. No. 5,213,928 to Yu, issued May 25, 1993, discloses an electrostatographic imaging member including a supporting substrate and an outer layer on the imaging side of the imaging member, the outer layer including minute spheres of a high molecular weight polysiloxane homopolymer homogeneously dispersed in a continuous film forming polymer matrix. The high molecular weight polysiloxane homopolymer forms pseudo solid pockets dispersed in the film forming polymer. Yu does not disclose any type of silicone oil as the dispersant.

Attempts at reducing the frictional damage caused by contact between the cleaning blade and the photoreceptor include adding a lubricant such as wax to the toner. However, the fixability of the toner may degrade its electrical function, or further filming may occur, resulting in a degraded image.

It is well known in the art that frictional forces can be reduced by applying a lubricant on the surface of the photosensitive drum. U.S. Pat. No. 4,519,698 to Kohyama et al. discloses a method in which a waxy lubricant is employed to constantly lubricate a cleaning blade. However, the thickness of the lubricant film formed on the photosensitive drum is difficult to maintain, and interference with the electrostatic characteristics of the photosensitive member occurs.

Attempts have also been made to construct a cleaning blade with a material having a low coefficient of friction. However, these attempts are subject to the problem of degradation in other characteristics, especially mechanical strength, due to the presence of additives.

According to U.S. Pat. No. 4,340,658 to Inoue et al. and U.S. Pat. No. 4,388,392 to Kato et al., surface smoothness of a photosensitive layer may be improved by the addition of a leveling agent such as polydimethylsiloxane to a polyvinyl carbazole type photoconductor.

When conventional silicone oil was sprayed onto the imaging surface of a charge transport layer to reduce friction, the charge transport layer cracked when bent, even without cycling.

Photoreceptors containing trace quantities of silicone oil are generally known in the art. Trace quantities of silicone oil have been used to affect improvements in surface properties of the dried film and improve flow out during the coating process. The quantity of silicone oil used in these known processes is too small to affect the bulk properties of the dried film. Any lubricating effect of silicone oil on the surface of the known photoreceptors is short lived because the silicone oil is quickly removed during normal abrasive wear due to toner, cleaning blades, brushes, paper contact and the like.

Thus, it is desirable to increase the durability and extend the life of exposed surfaces of a photoreceptor, as well as to reduce frictional contact between members of an organic photoconducting device while maintaining electrical and mechanical integrity and print quality.

U.S. Pat. No. 4,571,371 to Yashiki discloses an electrophotographic photoreceptor having a substrate, electroconductive layer, and a photosensitive layer. The electroconductive layer includes a silicone leveling agent, which improves the interfaces between the electroconductive layer and the other layers. However, the silicone leveling agent is contained in an inner layer of the photoreceptor, not in the outer imaging layer or overcoating layer for the purposes of reducing the coefficient or friction with a cleaning blade, lowering surface energy of the photoreceptor, or improving toner image transfer.

SUMMARY OF THE INVENTION

The present invention is directed to a photoreceptor having a reduced coefficient of friction when in contact with at least one cleaning blade and a method of making the photoreceptor.

The photoreceptor comprises a supporting substrate and an outer layer on an imaging side of the supporting substrate, the outer layer comprises between about 0.007 percent and about 0.35 percent by weight, based on the total weight of the materials used to form the outer layer, of silicone oil in the form of vesicles acting as reservoirs dispersed in a continuous film forming polymer matrix.

The present invention provides at least the following advantages over the prior art:

- a reduction of frictional contact between contacting members in an imaging device;
- lowered surface energy of the photoreceptor surface which reduces adhesion thereto of undesirable material such as toner, glue and paper fiber particles;
- enhanced cleaning efficiency of the imaging surface of an imaging member;
- an imaging member having an improved charge transport layer that does not adversely affect the electrical properties of the imaging member;
- an imaging member which provides improved toner image transfer to receiving members;
- improved cleaning blade life as a consequence of reduced frictional wear between the blade and the photoreceptor surface; and
- improved cleaning due to a reduction in blade tuck which causes deposits of toner on the photoreceptor surface in the area of the blade tuck.

The foregoing advantages and others are accomplished in accordance with the present invention by providing a photoreceptor comprising a supporting substrate and an outer layer on the photoreceptor, the outer layer comprising minute pockets of silicone oil in the form of vesicles dispersed in a continuous film forming polymer matrix. This photoreceptor may be used in an organic photoconducting development device that develops images by the steps of forming an electrostatic latent image on the photoreceptor surface, developing the electrostatic latent image with marking particles to form marking particle image in conformance with the electrostatic latent image, transferring the marking particle image to a receiving member, cleaning the photoreceptor surface and repeating the electrostatic latent image forming, developing, transferring and cleaning steps at least once. This photoreceptor is prepared by adding silicone oil to a mixture of at least one film forming polymer in at least one solvent and forming a dried outer layer in which the silicone oil is phase separated, forming vesicles or minute pockets of silicone oil that are essentially uniformly dispersed in the continuous film forming polymer matrix.

The photoreceptor according to the present invention promotes increased surface wear resistance and improved cleaning blade interaction in a xerographic copier/printer machine, superior to known conventional photoreceptors. The silicone oil vesicles or pockets act as silicone oil reservoirs, which continuously and uniformly supply silicone oil to the top surface of the photoreceptor throughout its operating life. Photoreceptor wear is reduced by reducing the surface friction with other machine components, especially the cleaning blade, eliminating the "stick and slip" behavior of the cleaning blade upon the photoreceptor surface. The photoreceptor of the present invention provides the disclosed advantages over conventional photoreceptors without negatively impacting the electrical performance of the organic photoconducting device or the print quality of an imaged sheet.

BRIEF DESCRIPTION OF THE DRAWING

The FIGURE is a schematic drawing of a slip/peel tester.

DETAILED DESCRIPTION OF PREFERRED EMBODIMENTS

The photoreceptor of the present invention provides the above-mentioned advantages over prior photoreceptors by incorporating silicone oil into the outer layer during the coating process. The silicone oil employed in the outer layer of this invention has a backbone of repeating —Si—O— segments.

In embodiments of the present invention, and as used herein, any of the various silicone oils may be used, including unsubstituted or substituted silicone oils. When substituted, the silicone oil can be substituted with any of the various functional groups, including but not limited to, alkyl such as methyl, ethyl, propyl and the like; alkylaryl such as metharyl, etharyl and the like; glycol residue; hydroxyalkyl such as hydroxymethyl, hydroxyethyl and the like; amino; ether and polyether; acrylic and methacrylic; mixtures thereof; and the like. Generally, the silicone oils are of the dimethyl silicone family, with a repeating unit of $—Si(CH_3)_2—O—$. The viscosity is preferably between about 50 and about 4,000 cPs, preferably from about 150 to about 250 cPs, measured at 25° C. Other silicone additives possessing a silicone backbone structure modified by side chains may also be employed in the present invention. These modifications generally involve the substitution of a polyether group in place of one or more methyl groups in the backbone of the dimethyl silicone structure. A description of these materials may be found in BYK Chemie, "Silicone Additives for Paints and Coatings," Product Information Si 1, pages 3–8. Further modifications of the poly(dimethyl) siloxane structure may involve the replacement of some methyl groups with higher alkyl groups such as $—(CH_2)_m—CH_3$, where m is from 1 to about 13, which is also described in the BYK Chemie publication at page 24. These materials herein described, and others structurally related to them, are considered to be within the scope of the present invention.

Satisfactory results may be obtained when the outer layer comprises between about 0.007 percent and about 0.35 percent by weight silicone oil based on the total weight of the dried outer layer. Preferably, the silicone oil is present in an amount between about 0.035 percent and about 0.35 percent, more preferably 0.035 percent and 0.14 percent, by weight based on the total weight of the outer layer. Optimum results are achieved with about 0.07 percent by weight silicone oil based on the total weight of the outer layer. These ranges may vary, however, depending upon the particular silicone oil used, the viscosity of the silicone oil, and its chemical structure, as described above. Furthermore, as used herein unless otherwise noted, the percent by weight values refer to percent by weight of the component based on the total weight of the materials, i.e., coating solution, used to form the outer layer. Thus, for example, the preferred silicone oil content of 0.07 percent by weight is based on the total coating solution, which contains substantial amounts of materials that are driven off or volatilized during drying of the coated layer. Thus, where a coating solution contains, for example, 80 percent by weight of carrier materials, the 0.07 percent by weight silicone in the coating solution is present in the final dried layer in an amount of about 0.35 percent by weight.

When the proportion of silicone oil increases beyond about 0.7 percent by weight, the desired mechanical properties may be unduly degraded and the imaging performance of the imaging member can be adversely affected as well. For example, when the outer layer is a charge transport layer, the imaging characteristics of the imaging member may begin to deteriorate. Delamination of the layer may also result. Also, the outer layer may be adversely affected by the presence of large amounts of silicone oil in this layer in that a film may develop on the photoreceptor that attracts small particulate contaminants and also adheres to the excess toner that is returned to the toner sump and is thus contaminated. In addition, excessive amounts of silicone oil can contaminate the surface of the copy paper during the image transfer step and preclude the ability to write on that surface with ball point or other liquid inks, pencils and the like. Furthermore, no additional advantages are achieved by the presence of greater amounts of silicon oil.

The minute pockets or vesicles of silicone oil dispersed in the continuous film forming polymer matrix preferably have an average size between about 0.01 and about 0.5 micrometers. Optimum results are achieved when the average particle size of the pockets is between about 0.08 micrometer and about 0.3 micrometers. When the average size of the pockets is too large, the large pockets may cause the formation of dark spots in the copy print out.

According to the present invention, the silicone oil is incorporated into the outer layer, i.e., on the imaging side, of the photoreceptor. Thus, depending on the construction of a particular photoreceptor, the silicone oil can be incorporated into any of the various layers, such as the charge generating layer, the charge transporting layer, or a protective overcoating layer. However, in embodiments, it is preferred that the outer layer, containing the silicone oil vesicles, is either the charge transporting layer or the protective overcoating layer.

Any suitable film forming polymer may be employed in the outer layer. Typical film forming polymers include, for example, various resin binders known for this purpose including, for example, polyesters, polycarbonates such as bisphenol polycarbonates, polyamides, polyether ketones, polysulfones, polyether sulfones, polystyrene, polyacrylate, polyurethanes, polyethercarbonates obtained from the condensation of N,N'-diphenyl-N,N'-bis(3-hydroxy phenyl)-[1,1'-biphenyl]-4,4'-diamine and diethylene glycol bischloroformate and the like. Other film forming polymers that may be employed in the outer layer are described below with reference to specific types of layers and can be used in combination with the silicone oil in the present invention.

The outer layer coating composition is prepared by mixing the silicone oil and at least one film forming polymer in one or more suitable solvents. Any suitable solvent or combination of solvents may be employed to mix the silicone oil and the at least one film forming polymer. The silicone oil, at least one film forming polymer and at least one solvent should be sufficiently compatible with each other, and any other component added, so as to form the outer layer. The solvent may be a single common solvent or a mixture of solvents that are soluble in each other. With the latter embodiment involving a combination of solvents, one of the solvents may more readily dissolve the film forming polymer and the other solvent may more readily dissolve the silicone oil. Typical solvents for silicone oils include, for example, methylene chloride, 1,1,1-trichloroethane, 1,1,2-trichloroethane, 1,1,2-trichloroethylene, normal hexane, cyclohexane, benzene, tetrahydrofuran, toluene, n-octylacetate, n-hexadecane, 2,4-dichlorotoluene, and the like and mixtures thereof. Typical solvents for film forming polymers include, for example, methylene chloride, 1,1,1-trichloroethane, 1,1,2-trichloroethane, 1,1,2-trichloroethylene, benzene, monochlorobenzene, tetrahydrofuran, toluene, and the like and mixtures thereof.

The outer layer coating may be applied by any suitable technique. Typical coating techniques include, but are not limited to, spray coating, draw bar coating, slot coating, slide coating, dip coating, roll coating, wire wound rod coating, and the like. Drying of the deposited coating may be effected by any suitable conventional technique such as oven drying, infra-red radiation drying, air impingement drying and the like.

The supporting substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or an organic composition. As electrically non-conducting materials, there may be employed various resin binders known for this purpose including polyesters, polycarbonates such as bisphenol polycarbonates, polyamides, polyurethanes, polystyrenes and the like. The electrically insulating or conductive substrate may be rigid or flexible and may have any number of different configurations such as, for example, a cylinder, a sheet, a scroll, an endless flexible belt, and the like.

The thickness of the substrate depends on numerous factors, including beam strength and economical considerations. For a flexible belt, the layer may be of substantial thickness, for example, preferably about 125 micrometers, or of a preferred minimum thickness of no less than 50 micrometers, provided there are no adverse effects on the final photoreceptor. In flexible belt embodiments, the thickness of this layer preferably ranges from about 65 micrometers to about 150 micrometers, and most preferably from about 75 micrometers to about 100 micrometers for optimum flexibility and minimum stretch when cycled around small diameter rollers, e.g. 19 millimeter diameter rollers.

The surface of the supporting substrate may comprise an electrically conductive material that extends through the thickness of the substrate or may comprise a layer or coating of electrically conducting material on a self supporting material. The conductive layer may vary in thickness over substantially wide ranges depending on the degree of optical transparency and flexibility desired for the photoreceptor. Accordingly, for a flexible photoreceptor, the thickness of the conductive layer may preferably be between about 20 angstroms to about 750 angstroms, and more preferably from about 100 angstroms to about 200 angstroms for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, vanadium, titanium, nickel, chromium, and the like. If desired, an alloy of suitable metals may be deposited. Typical metal alloys may contain two or more metals such as zirconium, vanadium, titanium, nickel, stainless steel, chromium, and the like, and mixtures thereof. The conductive layer need not be limited to metals.

A hole blocking layer may be applied to the conductive surface of the substrate. Generally, electron blocking layers for positively charged photoreceptors allow holes from the imaging surface of the photoreceptor to migrate toward the conductive layer. Some materials can form a layer that functions as both an adhesive layer and charge blocking layer. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because its cyclic stability is extended. The entire disclosure of U.S. Pat. No. 4,464,450 is incorporated herein by reference. Typical hydrolyzable silanes include 3-aminopropyltriethoxysilane, N-aminoethyl-3-aminopropyltrimethoxy-silane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl 3-amino)propyltriethoxy-silane, 3-aminopropylmethyldiethoxysilane, 3-aminopropyl trimethoxysilane, N-methylaminopropyltriethoxysilane, methyl[2-(3trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof.

Generally, satisfactory results may be achieved when the reaction product of a hydrolyzed silane and metal oxide layer forms a blocking layer having a thickness between about 20 Angstroms and about 2,000 Angstroms.

A preferred hole blocking layer comprises a reaction product between a hydrolyzed silane and the oxidized surface of a metal ground plane layer. The oxidized surface inherently forms on the outer surface of most metal ground plane layers when exposed to air after vacuum deposition. The hole blocking layer may be applied by any suitable conventional technique such as spraying, dip coating, draw bar coating, gravure coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The hole blocking layer should be continuous and preferably have a thickness of less than about 0.2 micrometer after drying because greater thicknesses may lead to undesirably high residual voltage.

An optional adhesive layer may be applied to the blocking layer. Any suitable adhesive layer well known in the art may be utilized. Typical adhesive layer materials include, for example, polyesters, duPont 49,000 (available from E. I. dupont de Nemours and Company), Vitel PE100 (available from Goodyear Tire & Rubber), polyurethanes, and the like. Satisfactory results may be achieved with a preferred adhesive layer thickness between about 0.05 micrometer (500 angstroms) and about 0.3 micrometer (3,000 angstroms). Conventional techniques for applying an adhesive layer coating mixture over the hole blocking layer include spraying, dip coating, extrusion coating, roll coating, wire wound rod coating, gravure coating, Bird applicator coating, and the like. Drying of the deposited coating may be effected by any suitable conventional technique such as oven drying, infra-red radiation drying, air impingement drying, vacuum drying and the like.

Any suitable photogenerating layer may be applied to the optional adhesive layer, which can then be overcoated with a contiguous hole transport layer as described hereinafter or these layers may be applied in reverse order. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium dyes, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder.

Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated herein by reference. Other suitable photogenerating materials known in the art may also be utilized, if desired.

Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidene chloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material preferably ranges in thickness of from about 0.1 micrometer to about 5.0 micrometers, and most preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, extrusion coating, and the like. Drying of the deposited coating may be effected by any suitable conventional technique such as oven drying, infra-red radiation drying, air impingement drying, vacuum drying and the like.

An active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer that may be employed in multilayered photoconductors of this invention, comprises from about 25 percent to about 75 percent by weight of at least one charge transporting aromatic amine compound, about 75 percent to about 25 percent by weight of a polymeric film forming resin in which the aromatic amine is soluble, and up to about 0.35 percent by weight silicone oil if the charge transport layer is the outer layer.

The charge transport layer forming mixture preferably comprises an aromatic amine compound of one or more compounds having the general formula:

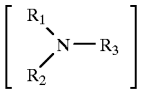

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should preferably be free from electron withdrawing groups such as $NO_2$ groups, CN groups, and the like.

Examples of charge transporting aromatic amines represented by the structural formula above for charge transport layers capable of supporting the injection of photogenerated holes of a charge generating layer and transporting the holes through the charge transport layer include bis(4-diethylamino-2-methylphenyl)phenyl-methane, 4'-4-bis(diethylamino)-2',2-dimethytriphenylmethane, N,N,'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'biphenyl]-4,4'-diamine, N,N'-diphenyl-N,N'-bis(3-methylphenyl)-(1,1'-biphenyl)-4,4'diamine, tritolyl amine, N,N-bis(3,4-dimethylphenyl)-1-aminobiphenyl, and the like dispersed in an inactive resin binder.

Any suitable inactive resin binder may be employed in the photoreceptors of this invention. Typical inactive resin binders include polycarbonate resin, polyether carbonate, polyester, polyarylate, polyacrylate, polyether, polysulfone, and the like. Weight average molecular weights can vary from about 20,000 to about 150,000.

Any suitable and conventional technique may be utilized to mix and thereafter apply the charge transport layer coating mixture to the charge generating layer. Typical application techniques include spraying, extrusion coating, dip coating, roll coating, wire wound rod coating, and the like. Drying of the deposited coating may be effected by any suitable conventional technique such as oven drying, infra-red radiation drying, air impingement drying and the like.

Preferably, the thickness of the transport layer is between about 10 to about 50 micrometers, but thicknesses outside this range can also be used. The transport layer should be an insulator to the extent that the electrostatic charge placed on the transport layer is not conducted in the absence of illumination at a rate sufficient to prevent formation and retention of an electrostatic latent image thereon. In general, the ratio of the thickness of the transport layer to the charge generator layer is preferably from about 2:1 to 200:1 and in some instances as great as about 400:1.

The preferred electrically inactive resin materials are polycarbonate resins having a weight average molecular weight from about 20,000 to about 150,000, more preferably from about 50,000 to about 120,000. The materials most preferred as the electrically inactive resin material is poly(4,4'-isopropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G. and a polycarbonate resin having a molecular weight of from about 20,000 to about 50,000 available as Merlon from Mobay Chemical Company poly(4,4'-cyclohexylidene diphenyl carbonate) (polycarbonate Z), poly(4,4'-isopropylidene-3,3'-dimethyl-diphenyl-carbonate); poly(4,4'-diphenyl-methyl phenylcarbonate); and the like. Methylene chloride or monochlorobenzene solvent is a preferred component of the charge transport layer coating mixture for adequate dissolving of all the components.

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507, the entire disclosures of which are incorporated herein by reference. The photoreceptors may comprise, for example, a charge generator layer sandwiched between a conductive surface and a charge transport layer as described above or a charge transport layer sandwiched between a conductive surface and a charge generator layer.

An especially preferred multilayered photoconductor comprises a charge generating layer comprising a photoconductive material and a contiguous transport layer of a film forming binder and an electrically active small molecule. A preferred transport layer comprises a polycarbonate resin material having a molecular weight of from about 20,000 to about 120,000 and having dispersed therein from about 25 to about 75 percent by weight of one or more compounds having the general formula:

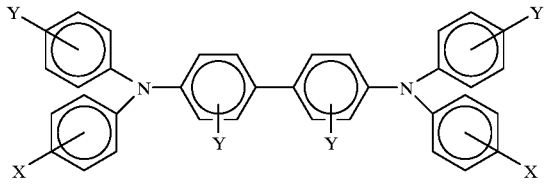

wherein X is an alkyl group, having from 1 to about 4 carbon atoms, and Y is H or an alkyl group having 1–4 carbon atoms.

In multilayered photoreceptors, the photoconductive charge generating layer should exhibit the capability of photogeneration of holes and injection of the holes, the charge transport layer being substantially non-absorbing in the spectral region at which the photoconductive layer generates and injects photogenerated holes but being capable of supporting the injection of photogenerated holes from the photoconductive layer and transporting the holes through the transport layer. If the photoconductive layer or charge generating layer is the outer layer in the imaging member of this invention, it can contain the uniformly dispersed silicone oil vesicles or pockets of this invention.

Other layers such as a conventional electrically conductive ground strip can be located adjacent to the charge transport layer along one edge of the belt in contact with the conductive layer, blocking layer, adhesive layer or charge generating layer to facilitate connection of the electrically conductive layer of the photoreceptor to ground or to an electrical bias. The ground strip layer comprises a film forming polymer binder and electrically conductive particles. Any suitable electrically conductive particles may be used in the electrically conductive ground strip layer. For example, the ground strip may comprise materials that include those enumerated in U.S. Pat. No. 4,664,995, the disclosure thereof being incorporated herein in its entirety. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized. The ground strip layer may preferably have a thickness from about 7 micrometers to about 42 micrometers, and most preferably from about 14 micrometers to about 27 micrometers. Since the ground strip can be an outer layer in the imaging member of this invention, it can contain the silicone oil of this invention. However, not all photoreceptors utilize a ground strip. If a ground strip is present, it may be present as an outer layer along with and adjacent to other outer layers that may be a film forming polymer containing charge generating layer, charge transport layer, overcoating layer or dielectric layer. If the ground strip is present on the photoreceptor as an outer layer, either the adjacent outer layer alone or both the ground strip and the adjacent outer layer may contain the uniformly dispersed silicone oil vesicles or pockets of this invention.

If an overcoat layer comprising a film forming polymer binder is employed, it will be an outer layer in which the silicone oil may be added. Overcoatings without a silicone oil are well known in the art and are either electrically insulating or slightly hole transporting. When overcoatings are employed on the photoreceptor of this invention, it should be continuous. The overcoating layer may preferably range in thickness from about 2 micrometers to about 8 micrometers, and more preferably from about 3 micrometers to about 6 micrometers. An optimum range of thickness is from about 3 micrometers to about 5 micrometers.

In some cases an anti-curl back coating may optionally be applied to the side opposite the imaging side of the photoreceptor to enhance flatness and/or abrasion resistance. The anti-curl back coating layers are well known in the art and may comprise film forming polymers, examples of which are polyacrylates, polystyrene, poly(4,4'-isopropylidene diphenyl carbonate), 4,4'-cyclohexylidene diphenyl polycarbonate, and the like. An adhesion promoter additive may also be used. Usually from about 1 to about 15 weight percent of adhesion promoter is added to the anti-curl back layer. Typical adhesion promoter additives include 49,000 (available from E. I. du Pont de Nemours & Co.), Vitel PE-100, Vitel PE-200, Vitel PE-307 (Goodyear Chemical), and the like. The thickness of the anti-curl layer is preferably between about 3 micrometers and about 35 micrometers.

For one embodiment of photoreceptors, a flexible dielectric layer overlying the conductive layer may be substituted for the photoconductive layers. Any suitable, conventional, flexible, electrically insulating dielectric film forming polymer may be used in the dielectric layer of the electrographic imaging member. These dielectric layers may contain the uniformly dispersed silicone oil vesicles or pockets, if the dielectric layer is the outer layer on the imaging side of the photoreceptors.

The silicone oil additive of this invention is preferably nontoxic, inert, resistant to ultraviolet light, does not degrade or otherwise adversely affect electrical properties of the outer layer, and improves the wear resistance and frictional properties of the outer layer.

A following examples are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLES

Example I

A control photoreceptor is prepared by providing an aluminum drum substrate, and applying thereto, using a dip coating technique, a charge transport coating solution containing:

| Component | Parts by Weight |
|---|---|
| polycarbonate-z400 | 12 |
| N,N'-diphenyl-N,N'-bis[3-methylpropyl]-[1,1'biphenyl]-4,4'-diamine | 8 |
| 2,6-di-t-butyl-4-methylphenol | 0.2 |
| tetrahydrofuran | 59 |
| monochlorobenzene | 20 |
| toluene | 0.6 |

This layer is then dried. The resulting coating layer has a dry thickness of 25 microns.

Example II

A photoreceptor as described in control Example I is prepared using the same procedures and materials except that a charge transport layer of the present invention is used in place of the charge transport layer of control Example I. The charge transport layer solution of the invention is prepared by mixing the following coating solution and applying the solution to an aluminum drum substrate using a dip coating technique, as in control Example I:

| Component | Parts by Weight |
|---|---|
| polycarbonate-z400 | 12 |
| N,N'-diphenyl-N,N'-bis[3-methylpropyl]-[1,1'biphenyl]-4,4'-diamine | 8.0 |

-continued

| Component | Parts by Weight |
|---|---|
| 2,6-di-t-butyl-4-methylphenol | 0.2 |
| silicone oil | 0.07 |
| tetrahydrofuran | 59 |
| monochlorobenzene | 20 |
| toluene | 0.6 |

The fabricated photoreceptor bearing the wet coating is dried to give a 25 micrometers dry thickness charge transport layer containing approximately 0.35 weight percent of silicone oil based on the total weight of the dried charge transport layer. Since the silicone oil precipitates out (or phase separates) from the matrix polymer to form minute spheres or vesicles, the resulting charge transport layer is slightly hazy on careful examination.

Comparative Test I

The photoconductive imaging members of Examples I and II are evaluated for surface contact adhesion by applying a 1.3 cm (0.5 inch) width Scotch brand Magic Tape #810, available from 3M Company, over the outer charge transport layer of each photoreceptor for a peel test measurement. The step by step procedures used for a 180° tape peel measurement are as follows:

a) Prepare a 2.54×0.16×7.62 cm (1"×1/16"×3") aluminum (Al) backing plate.

b) Place a double sided adhesive tape over the Al backing plate to facilitate photoreceptor sample mounting. For successful peel measurement, the selected double sided tape should have a 180° adhesive peel strength of at least 900 gm/cm with both the Al plate and with the test photoreceptor sample.

c) Cut a piece of test specimen of 2.54×15.24 cm (1.0"×6") from each imaging sample and apply a 1.3 cm (½ inch) width Scotch brand Magic Tape #810 onto the outer surface of the charge transport layer of the test specimen of each photoreceptor.

d) For the tape peel measurement, press the test specimen (bearing the applied Scotch brand Magic Tape) with its back side against the double sided tape/Al backing plate. Ensure that the lower edge of the specimen is positioned evenly with the bottom of the plate.

e) Insert the test specimen with the Al backing plate into the jaws of an Instron Tensile Tester.

f) Set the load range of the Instron chart recorder at 500 grams full scale for a 180° tape peel measurement. With the jaw crosshead speed at 2.54 cm/min (1 inch/min) and the chart speed at 5.08 cm/min (2 inch/min), peel the tape at least 5.08 cm (2 inches) off from the charge transport layer surface.

The results indicate that the surface energy of the charge transport layer of this invention, as reflected by the reduction of tape peel strength, is greatly reduced to improve blade/imaging member surface cleaning efficiency during cyclic xerographic processes.

Comparative Test II

A coefficient of friction test is conducted by fastening the photoconductor of control Example I, with its charge transport layer (having no additive) facing upwardly, to a platform surface. A polyurethane elastomeric cleaning blade is then secured to the flat surface of the bottom of a horizontally sliding plate weighing 200 grams. The sliding plate is dragged in a straight line over the platform, against the horizontal test imaging sample surface, with the surface of the cleaning blade facing downwardly. The sliding plate is moved by a thin cable that has one end attached to the plate and the other end threaded around a low friction pulley and fastened to the jaws of an Instron Tensile Tester. The pulley is positioned so that the segment of the cable between the weight of the sliding plate and the pulley is parallel to the surface of the flat horizontal test surface. The cable is pulled vertically upward from the pulley by the jaw of the Instron Tensile Tester and the load required to cause the cleaning blade to slide over the charge transport layer surface is monitored with a chart recorder. The coefficient of friction test for the charge transport layer against the cleaning blade is repeated again as described above, except that the photoconductive imaging member of control Example I is replaced with the photoreceptor Example II using fresh blades for each test.

The results obtained for coefficient of friction tests show that the charge transport layers of this invention having 0.07 weight percent silicone oil incorporated therein achieve a large reduction in coefficient of surface contact friction when rubbed against the polyurethane cleaning blade as well as an improvement in wear resistance against a glass skid plate when compared to the control photoreceptor of Example I.

Comparative Test III

The electrical properties of the photoreceptors prepared according to Examples I and II are evaluated with a xerographic testing scanner comprising a cylindrical aluminum drum having a diameter of 24.26 cm (9.55 inches). The test samples are taped onto the drum. When rotated, the drum carrying the samples produces a constant surface speed of 76.3 cm (30 inches) per second. A direct current pin corotron, exposure light, erase light, and five electrometer probes are mounted around the periphery of the mounted photoreceptor samples. The sample charging time is 33 milliseconds. Both expose and erase lights are broad band white light (400–700 nm) outputs, each supplied by a 300 watt output Xenon arc lamp.

The test samples are first rested in the dark for at least 60 minutes to ensure achievement of equilibrium with the testing conditions at 40 percent relative humidity and 21° C. Each sample is then negatively charged in the dark to a development potential of about 900 volts. The charge acceptance of each sample and its residual potential after discharge by front erase exposure to 400 ergs/cm$^2$ is recorded. The test procedure is repeated to determine the photo induced discharge characteristic of each sample by different light energies of up to 20 ergs/cm$^2$.

The 50,000 cycles electrical test shows that addition of silicon oil in the amount of 0.07 weight percent in the charge transport layer for the photoreceptor sample of Example II gives essentially equivalent dark decay rate, residual voltage, photo induced discharge characteristic and 50,000 cycles cycle-down when compared to the control photoreceptor sample of Example I.

The mechanical and electrical cyclic results obtained for the test sample of Example II are of particular importance because they indicate that incorporation of silicone oil of the present invention into the charge transport layer not only improves the desired mechanical and frictional properties of the resulting charge transport layer, but it also maintains the crucial electrical integrity of the photoreceptor.

Incorporation of silicone oil in the charge transport layer of this invention as described in Example II, at a loading level of about 0.07 weight percent, does not alter the optical clarity of the charge transport layer. The maintenance of light transmittance characteristics of this layer is essential to achieve proper photoelectric functions during xerographic imaging processing.

Comparative Test IV

A 180° tape pull test is carried out to determine the effect of silicone oil loading on the surface properties of the photoreceptor, before and after abrasive wear. The test is carried out on an INSTRUMENTORS, Inc. Slip/Peel Tester, Model 3M90. The apparatus is essentially a device that pulls a tape affixed to the test sample. The force required to pull the tape from the sample is a relative measure of the release properties of the material.

The slip/peel tester is operated at 0.5 inches/minute. The tape used in the pull test is ½ inch "Magic Tape" #810, product number 07377-9, a product of the 3M Company. A schematic drawing of the test apparatus appears in the FIGURE.

The samples are prepared using varying amounts of silicone oil in the transport layer formulation. The transport layers are prepared generally according to the process described in Examples I and II, above. The relative loadings of silicone oil in the tests are listed in Tables I and II. For comparison, a control test is also run, which does not contain any silicone oil.

Each data point is an average of 10 readings, unless otherwise noted. That is, each test on each sample is run 10 times to provide an average result. The first few readings (generally low) are discarded until the slack in the tape is taken up between the clamp and the 180° bend in the tape.

The results of test taken before abrasion of the transport layer are presented in Table I.

TABLE I

180° Peel Test Before Abrasion

| Silicone Oil Loading | Pull Force (grams/cm) | Observations |
|---|---|---|
| 0% (Control) | 245 | Clear solution |
| 0.007% | 229 | Clear solution |
| 0.035% | 246 | Clear solution |
| 0.07% | 215 | Clear solution |
| 0.14% | 214 | Coating solution slightly cloudy |
| 0.35% | 186 | Coating solution cloudy |
| 0.7% | Sample delaminated | Sample coating solution very cloudy. Coated film has slick, oily surface, smudges on contact. Film delaminated. |

Next, the samples are abraded with "Crocus cloth", K624, a product of Norton Abrasives Co. Strips 4"×1" are cut. A pressure of 5# is applied to a backing pad and each 1"×8" sample is given four back and fourth passes under the Crocus cloth abrader. A fresh surface of Crocus cloth is exposed and the four stroke abrading process is repeated on the sample. The results of the slip peel test on the abraded samples is contained in Table II.

TABLE II

180° Peel Test After Abrasion

| Silicone Oil Loading | Pull Force (grams/cm) | Observations |
|---|---|---|
| 0% (Control) | 366 | Clear solution |
| 0.007% | 285 | Clear solution |

TABLE II-continued

180° Peel Test After Abrasion

| Silicone Oil Loading | Pull Force (grams/cm) | Observations |
|---|---|---|
| 0.035% | 267 | Clear solution |
| 0.07% | 286 | Clear solution |
| 0.14% | 263 | Coating solution slightly cloudy |
| 0.35% | 214 | Coating solution cloudy Some samples delaminated |
| 0.7% | 205* | Coating solution, very cloudy. Coated film has slick, oily surface, smudges on contact. |

*average of 5 data points rather than usual 10 due to sample delamination during testing The differences in the peel force of the samples, compared before and after abrading, is presented in Table III.

TABLE III

| Silicone Oil Loading | Pull Force (grams/cm) | Observations |
|---|---|---|
| 0% (Control) | 121 | |
| 0.007% | 56 | |
| 0.035% | 21 | |
| 0.07% | 71 | |
| 0.14% | 49 | |
| 0.35% | 28 | |
| 0.7% | — | Pre-abrasion data not available |

Based on these results, it is shown that without silicone oil present, abrasion substantially increases the surface energy. The upper limit is between 0.14 wt. %) and 0.35 wt. %, since the solutions are slightly cloudy and lead to delamination. The lower limit appears to be about 0.035 wt. %, since an inflection point in the data occurs about at this concentration.

Although the invention has been described with reference to specific preferred embodiments, it is not intended to be limited thereto. Rather, those skilled in the art will recognize that variations and modifications may be made therein, which are within the spirit of the invention and within the scope of the claims.

What is claimed is:

1. A photoreceptor comprising a supporting substrate and an outer layer on an imaging side of said photoreceptor, said outer layer comprising between about 0.007 percent and about 0.35 percent by weight, based on the total weight of a coating solution of said outer layer, of silicone oil vesicles uniformly dispersed in a continuous film forming polymer matrix.

2. A photoreceptor according to claim 1, further comprising a charge generating layer and wherein said outer layer is a charge transport layer comprising charge transport molecules molecularly dispersed in said continuous film forming polymer phase to form a continuous charge transport material, and said silicone oil vesicles are dispersed in said charge transport material.

3. A photoreceptor according to claim 1, wherein said outer layer is an overcoating layer.

4. A photoreceptor according to claim 1, wherein said silicone oil vesicles have an average diameter of between about 0.01 micrometer and about 0.5 micrometer.

5. A photoreceptor according to claim 4, wherein said silicone oil vesicles have an average diameter between about 0.08 and about 0.3 micrometer.

6. A photoreceptor according to claim 1, wherein said outer layer has a thickness of between about 0.2 micrometer and about 70 micrometers.

7. A photoreceptor according to claim 1, wherein said outer layer comprises between about 0.035 percent and about 0.35 percent by weight of said silicone oil based on the total weight of said coating solution of said outer layer.

8. A photoreceptor according to claim 7, wherein said outer layer comprises between about 0.035 percent and about 0.14 percent by weight of said silicone oil based on the total weight of said coating solution of said outer layer.

9. A photoreceptor according to claim 1, wherein said film forming polymer is selected from the group consisting of polyesters, polycarbonates, polyamides, polystyrene, polyacrylates, polyurethanes, polyethercarbonates, polyether ketones, polysulfones, polyether sulfones, and mixtures thereof.

10. A photoreceptor according to claim 1, wherein said silicone oil is present in said outer layer in an amount from about 0.035 percent to about 1.75 percent by weight, based on a dry weight of said outer layer.

11. A photoreceptor according to claim 1, wherein said silicone oil is an unsubstituted or substituted silicone oil.

12. A photoreceptor according to claim 11, wherein said silicone oil is a substituted silicone oil substituted with at least one functional group selected from the group consisting of alkyl groups, alkylaryl groups, glycol residues, hydroxyalkyl groups, amino groups, ether and polyether groups, acrylic and methacrylic groups, and mixtures thereof.

13. A photoreceptor according to claim 11, wherein said silicone oil is a dimethyl silicone oil having a viscosity of from about 50 to about 4,000 cPs at 25° C.

14. A process for preparing a photoreceptor comprising:

providing a supporting substrate;

forming a charge generating layer on said supporting substrate;

applying an outer layer coating solution comprising at least one film forming polymer, between about 0.007 percent and about 0.35 percent by weight based on the total weight of said coating solution of a silicone oil, and at least one solvent for said at least one film forming polymer and said silicone oil to form a wet outer layer; and drying said wet outer layer to remove said solvent, whereby a dried outer layer is formed comprising a continuous matrix of said film forming polymer and said silicone oil uniformly dispersed as vesicles in said continuous matrix of said film forming polymer.

15. A process according to claim 14, wherein said coating solution further comprises a charge transporting material.

16. A process according to claim 14, wherein said dried outer layer is an outer layer selected from the group consisting of a charge transport layer and a protective overcoating layer.

17. A process according to claim 14, wherein after said drying step, said silicone oil is present in said dried outer layer in an amount from about 0.035 percent to about 1.75 percent by weight, based on a total weight of said dried outer layer.

* * * * *